US006047505A

United States Patent [19]

Willow

[11] Patent Number: 6,047,505

[45] Date of Patent: Apr. 11, 2000

[54] EXPANDABLE BASE BEARING PILE AND METHOD OF BEARING PILE INSTALLATION

[76] Inventor: Robert E. Willow, 118 Warwick Dr. #70, Benicia, Calif. 94510

[21] Appl. No.: 08/980,560

[22] Filed: Dec. 1, 1997

[51] Int. Cl.[7] ..... E02D 5/54

[52] U.S. Cl. ..... 52/98; 52/155; 405/253

[58] Field of Search ..... 52/98, 155, 741.15, 52/745.21, 158, 165; 405/234, 237, 253, 259.1, 259.3

[56] References Cited

U.S. PATENT DOCUMENTS

| | | | |
|---|---|---|---|
| 3,115,226 | 12/1963 | Thompson, Jr. | 52/98 |
| 3,228,153 | 1/1966 | Luedloff . | |
| 3,233,415 | 2/1966 | Thomas . | |
| 3,304,671 | 2/1967 | Kintish et al. | 52/155 |
| 3,305,985 | 2/1967 | Dean | 52/155 |
| 3,324,666 | 6/1967 | Lee | 52/155 |
| 3,333,540 | 8/1967 | Clark et al. | 52/155 |
| 3,343,313 | 9/1967 | Luedloff et al. | 52/155 |
| 3,432,977 | 3/1969 | Scholl | 52/98 |
| 4,593,500 | 6/1986 | Watson . | |
| 4,648,220 | 3/1987 | Gebelius . | |
| 5,301,481 | 4/1994 | Novak . | |

*Primary Examiner*—Michael Safavi
*Attorney, Agent, or Firm*—Harris Zimmerman

[57] ABSTRACT

Load bearing capacity of a pile which is driven into the ground to support any of various structures is markedly increased following an initial period of pile driving. The pile includes a hollow pipe having a lower end region with longitudinal grooves which extend upward from an earth piercing shoe at the base of the pipe. An expansive force is exerted on the lower end region after the initial pile driving to rupture the pipe at the grooves and to bend strips of the pipe material outward for a first distance. Further pile driving bends the strips further outward as downward motion of the strips is resisted by the rim of the shoe and by ground which underlies the strips. This enables use of shorter piles and reduces driving time.

5 Claims, 7 Drawing Sheets

FIG. 3
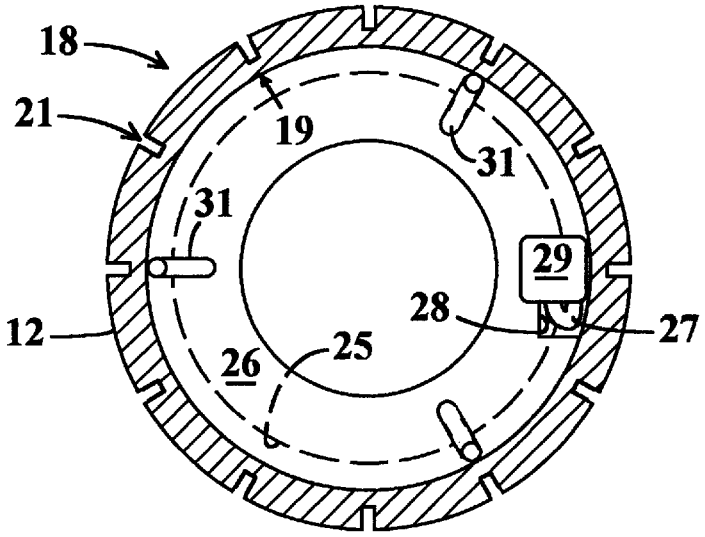
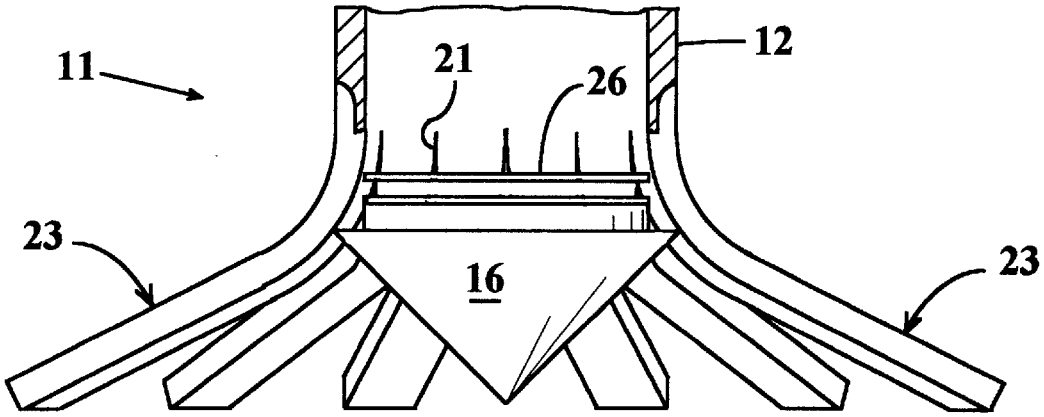
FIG. 5

EXPANDABLE BASE BEARING PILE AND METHOD OF BEARING PILE INSTALLATION

TECHNICAL FIELD

This invention relates to the support of structures and more particularly to bearing piles which extend into the ground to provide support for buildings, bridges, wharves or diverse other constructions.

BACKGROUND OF THE INVENTION

Bearing piles must be driven into the ground for a distance sufficient to provide a load bearing capacity that is determined by the weight of the structure which is supported by the piles. This does not pose problems in instances where rock is present close to the surface of the ground. A pile is simply driven firmly into the rock. One or a combination of two other techniques have traditionally been used in instances where rock lies deep below the surface of the ground.

A first such technique, termed friction bearing, relies on the progressive increase in frictional resistance to further penetration that occurs as a pile is driven progressively further into the ground. This resistance can be determined by measuring the penetration which occurs in response to each pile driver blow and at some point becomes sufficient to support the load which the pile is to bear. The other technique, termed end bearing, involve driving the pile through unconsolidated surface material until sufficiently stiff, consolidated or hard material is encountered to provide the desired load bearing capacity by soil pressure against the base of the pile.

Either of the above described techniques usually requires a very lengthy penetration of the pile into the ground. It would be advantageous to reduce the costs of pile material and pile driving time by enabling adequate load bearing capacity at shallower depths of penetration.

Various methods have used to achieve this goal by enlarging the end bearing area of the pile with a body of concrete. This may, for example, involve excavation of a sizable cavity at the base of the pile within a bell caisson or forming of a rammed concrete pile by hammering fresh concrete down a tubular pile casing. In some instances a cavity for receiving the concrete has been formed by detonating an explosive at the base of the pile. All of these methods require costly specialized equipment and material, are time consuming and can be dangerous to persons involved in installation of the pile. In addition the load bearing capacity of these installations is speculative since no dynamic loading occurs after the enlargement.

The present invention is directed to overcoming one or more of the problems discussed above.

SUMMARY OF THE INVENTION

In one aspect the present invention provides a method of implanting a bearing pile in the ground which bearing pile is formed at least in part by a hollow pipe which is penetrated into the ground. The lower end region of the pipe is provided with a plurality of longitudinally extending grooves. An earth piercing shoe is disposed at the lower end region of the pipe which shoe has an outside diameter that is greater than the inside diameter of the lower end of the pipe. The pipe and driving shoe are driven into the ground after which an expansive force is exerted on the lower end region of the pipe which force is of sufficient magnitude to rupture the lower end region at the grooves and to cause strips of the material of the pipe to flare outward sufficiently to span the earth piercing shoe. The pipe is subsequently driven further into the ground against the resistance of the earth piercing shoe and against the resistance of ground which underlies the strips to cause the strips to bend further outward.

In another aspect of the invention, a method of implanting a bearing pile in the ground includes the step of disposing an earth piercing shoe at the lower end of a hollow pipe which earth piercing shoe has an outer diameter that exceeds the inside diameter of the lower end of the pipe. The pipe is provided with a plurality of weakened zones that extend upward from the lower end of the pipe at spaced apart angular intervals around the circumference of the lower end region of the pipe. The pipe and earth piercing shoe are then driven into the ground. The lower end of the pipe is then expanded sufficiently to rupture the pipe at the weakened zones and to bend strips of the pipe material outward for a distance sufficient to enable sliding passage of the strips past the earth piercing shoe during subsequent driving of the pipe into the ground. The lower end of the pipe is then further expanded by forcing the pipe downward against the earth piercing shoe and against ground which underlies the strips.

In another aspect the invention provides a structure supporting bearing pile which includes a pipe having a main body which extends down into the ground and having a deformed lower end region at which material of which the pipe is formed divides into strips that extend outward from the main body in different directions. An earth piercing shoe is disposed at the lower end region of the pipe and has an undersurface which bears against underlying ground and a peripheral region which contacts undersurfaces of the strips.

In the method of the invention, the base of a tubular pile is given an initial expansion by explosive means or by mechanical means after an initial amount of penetration of the pile and an underlying earth piercing shoe into the ground. The initial expansion need only be sufficient to enable the enlarged base of the pile to slide past the earth piercing shoe as the pile is driven further into the ground. The resistance created by the earth piercing shoe and the resistance of surrounding ground then wedges strips of the pile material further outward as the pile is penetrated further into the ground. This rapidly enlarges the base of the pile and rapidly increases the load bearing capacity of the pile. Consequently the invention enables attainment of desired load bearing capacity with a greatly reduced penetration into the ground. This results in substantial saving of materials and of driving time. The invention enables advantage to be taken of thin layers of stiff load bearing material that may be encountered during driving of a pile into the ground. Subsurface excavation of a cavity at the base of the pile and filling of the cavity with concrete is not necessary. Only a minimal amount of explosive is needed in those forms of the invention which use explosive means to effect the initial expansion of the base of the pile.

The invention, together with further aspects and advantages thereof, may be further understood by reference to the following description of the preferred embodiments and by reference to the accompanying drawings.

BRIEF DESCRIPTION OF THE DRAWINGS

FIG. 3 is a cross section view taken along line 3—3 of FIG. 2.

FIG. 5 is another elevation section view of the lower end region of the pile of the preceding figures as it appears following completion of the installation of the pile.

DETAILED DESCRIPTION OF THE PREFERRED EMBODIMENTS

Figure 1:
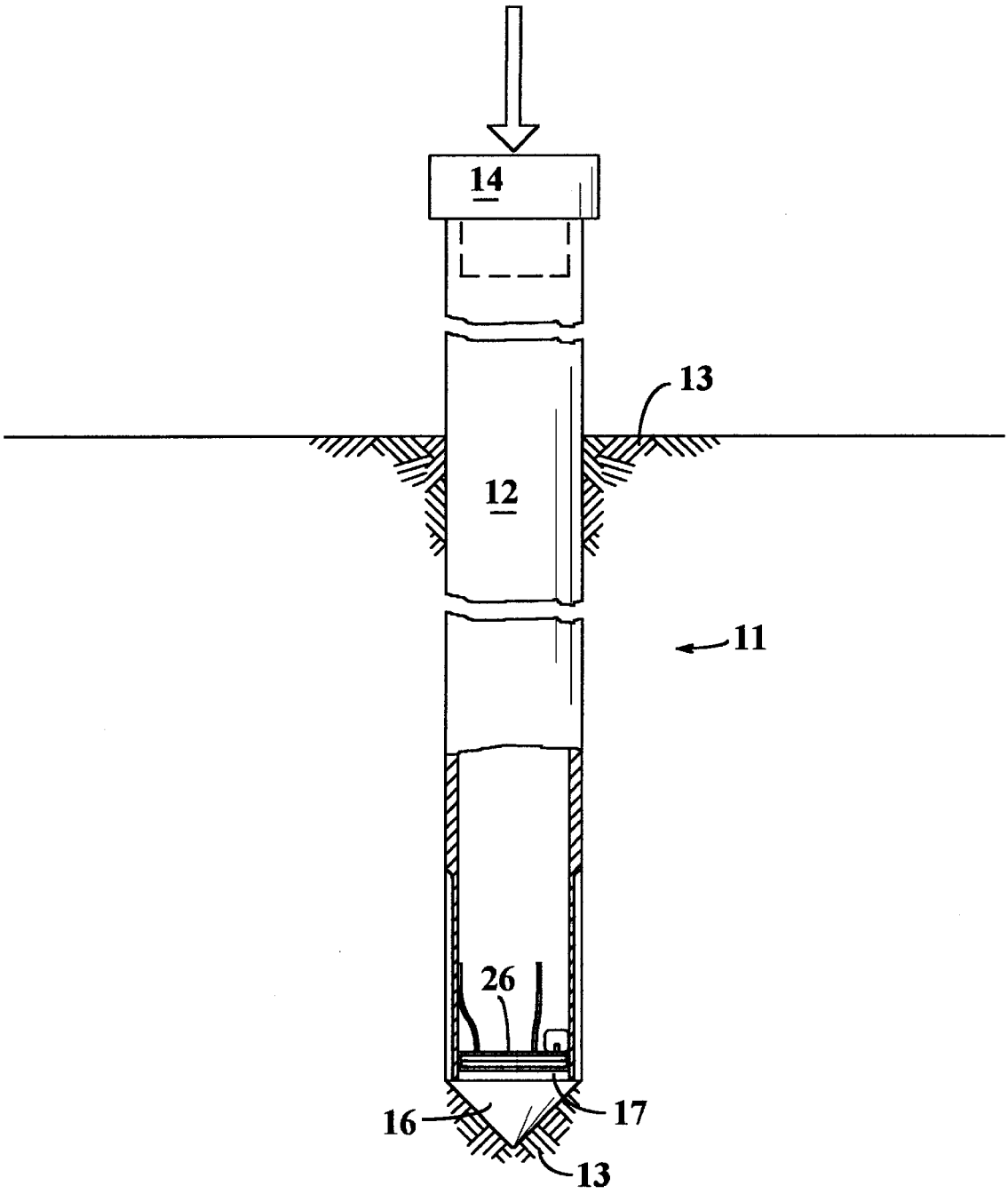
FIG. 1 is a foreshortened and partially broken out elevation view of a bearing pile in accordance with a first embodiment of the invention.
Figure 2:
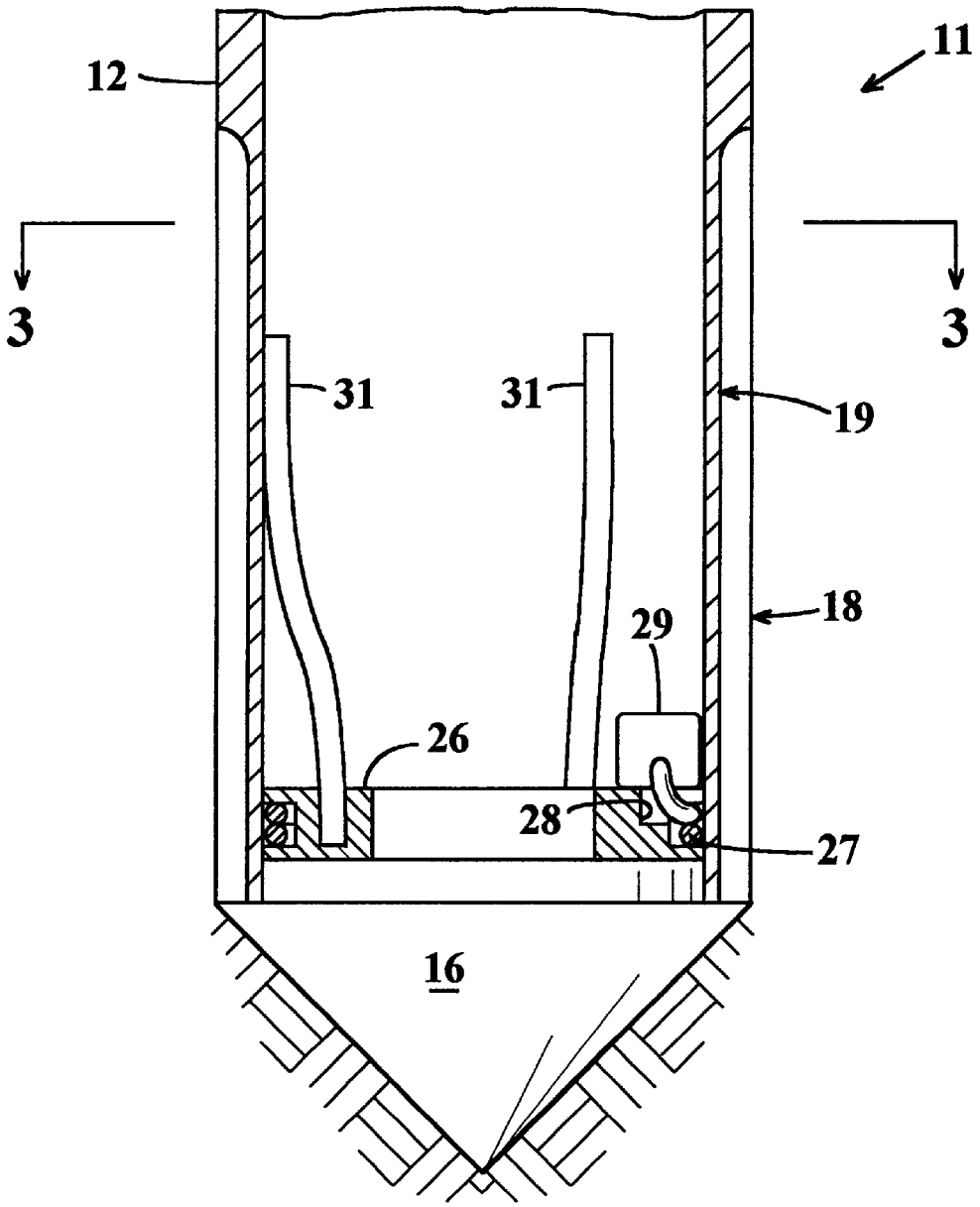
FIG. 2 is an enlarged elevation view of the lower end region of the apparatus of FIG. 1 as it appears during an early stage in the installation of the pile.

Referring initially to FIGS. 1 and 2 of the drawings, a bearing pile 11 embodying the invention includes an upright hollow pipe 12 which is hammered into the ground 13 using pile driving equipment which may be of the known construction. A removable cap 14 is seated in the upper end of pipe 12 at least during driving of the pile 11. A downward directed conical earth piercing shoe 16 is disposed at the base of pipe 12. Shoe 16 has a diameter which conforms with the outside diameter of the base of pipe 12 prior to enlargement of the base of the pipe in a manner which will be hereinafter be described. A circular boss 17 at the top of shoe 16 has a diameter conforming to the inside diameter of pipe 12 and extends a short distance up into the pipe to maintain the shoe in position during the initial stage of driving of the pile 11. Pipe 12 preferably has a circular cross section and is preferably formed of high strength steel although other cross sectional configurations and other materials may be appropriate under some conditions. At least the lower end of pipe 12 may be formed of or be clad with stainless steel or other corrosion resistant material in instances where corrosion may cause problems.

Referring jointly to FIGS. 2 and 3, the lower end region 18 of pipe 12 initially has weakened zones 19 which extend upward from the lower end of the pipe, the zones preferably being located at equal angular intervals around the circumference of the pipe. The zones 19 are created by grooves 21 in the outer wall which extend longitudinally along the pipe 12.

Figure 4:
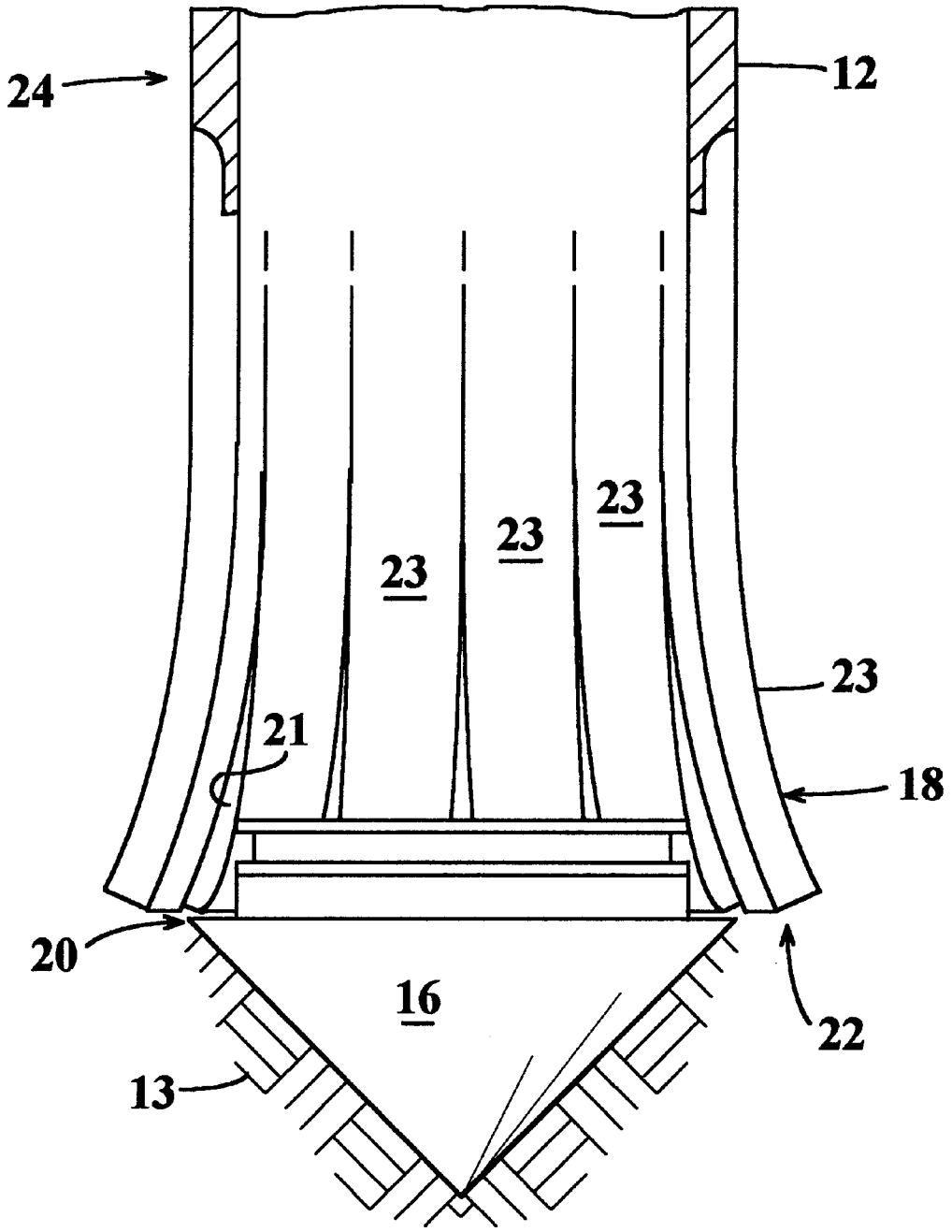
FIG. 4 is an elevation section view of the lower end region of the pile of the preceding figures as it appears following an initial expansion of the lower end of the pile which initial expansion is effected by explosive means in this particular embodiment of the invention.

Referring again to FIG. 1, steps in the method of the invention include driving the pipe 12 and shoe 16 into the ground for a distance that may be substantially smaller than the distance that would create the desired final load bearing capacity using conventional pile driving techniques. Referring to FIG. 4, an expansive force is then exerted on the lower end region 18 of pipe 12. The force is of sufficient magnitude to rupture the lower end region 18 at grooves 21 and to cause the inside diameter of the lower end 22 of the pipe to become at least sufficient to fully span the underlying earth piercing shoe 16. The expansive force separates the lowermost region of the pipe 12 into strips 23 which flare outward relative to the main body 24 of the pipe. Techniques for creating the expansive force will be hereinafter described.

The pipe 12 is then driven further into the ground 13. This causes the inner surfaces of strips 23 to contact the periphery 20 of shoe 16. Shoe 16 then exerts a wedging force which acts to bend strips 23 further outward from the main body 24 of pipe 12 as the downward movement of the shoe itself is resisted by the pressure of underlying earth 13. The wedging force is augmented by direct pressure of underlying earth 13 against the strips 23 as the pipe 12 and shoe 16 continue to travel downward. Outward bending of the strips 23 rapidly deforms the lower end of pipe 12 into the configuration depicted in FIG. 5 at which the effective bearing area at the base end of the pile and therefore the load bearing capacity have been greatly increased.

Techniques for computing the changes of load bearing capacity which occur as a pile is being driven into the ground, by measuring the penetration which occurs in response to a pile driver blow of known magnitude, are known to the art. These techniques may be used to determine when further driving of the pile of the present invention becomes unnecessary.

The ability to rapidly expand the base of the pile 11 at a selected depth in the ground makes it possible to take advantage of thin layers of relatively stiff ground material that may be encountered as a pile is being driven into the ground. The base of the pile 11 may be rapidly expanded when an abrupt increase in resistance to penetration of the pile is detected indicating that a layer of this kind may be present. If the layer is sufficiently thick only minimal further penetration of the pile into the ground may be needed.

Exertion of the initial expansive force on the lower end of the pipe 12 may be effected in any of a variety of different ways including by explosive means or by mechanical devices. For example, with reference again to FIGS. 2 and 3, an explosive carrier ring 26 may be dropped through the pipe 12 after the initial stage of driving of the pile 11 into the ground. The explosive 27 in this example is a winding of primacord situated within a groove 25 that extends around the circumferential surface of the ring 26. One end of the primacord 27 extends up through a notch 28 in the rim of ring 26 to connect with a detonator 29 which is secured to the top surface of the ring. Detonator 29 can be of the type which is ignited by a fuse or, preferably be of the known time delay type which can be set to detonate after elapse of a predetermined period of time. Guide rods 31 extend upward from the top of ring 26 at angular intervals around the ring and are curved to extend into contact with the inner wall of pipe 12. This assures that the ring 26 remains in coaxial relationship with pipe 12 as it drops through the pipe.

Figure 6:
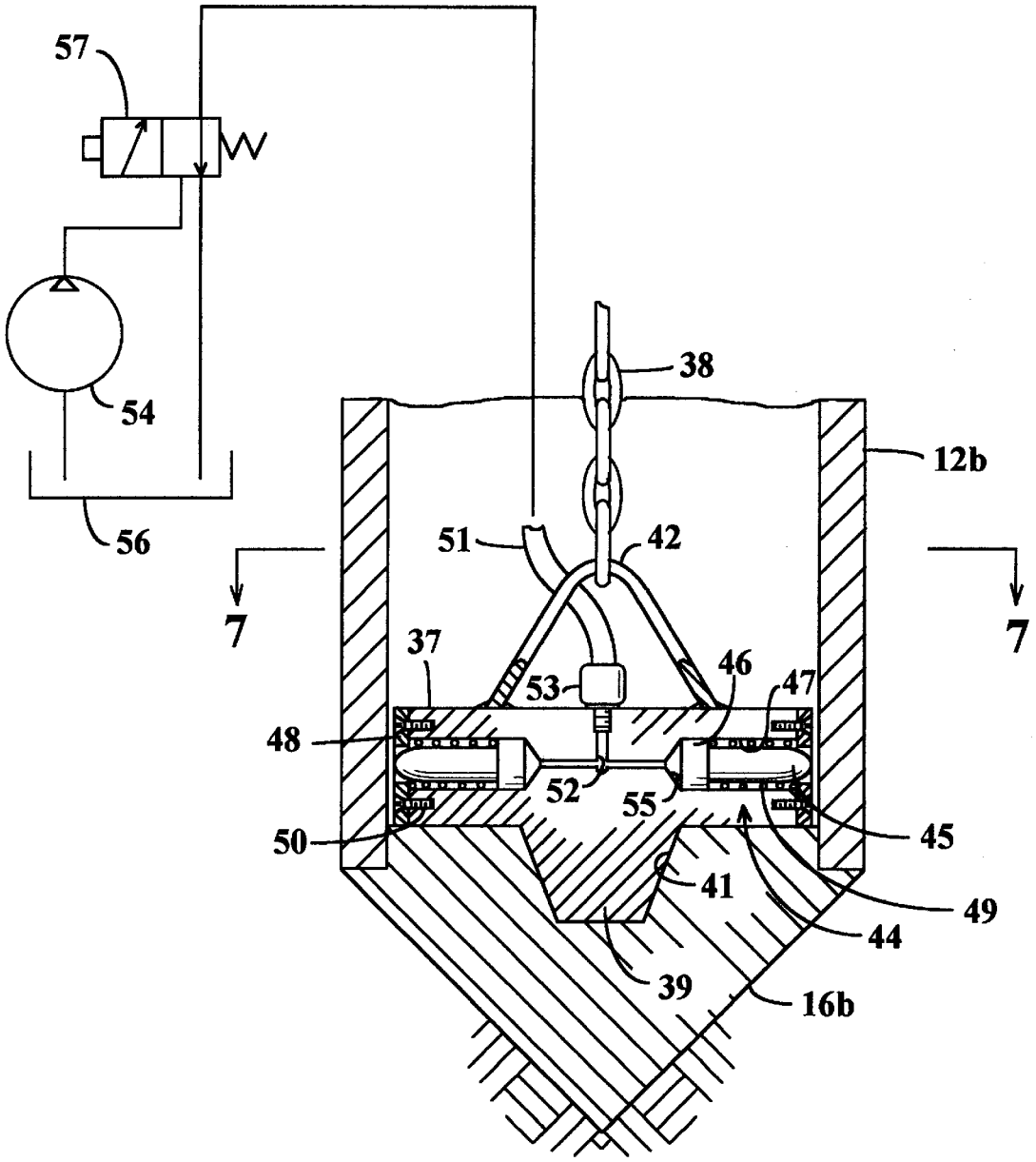
FIG. 6 is an elevation section view of the lower end region of a bearing pile illustrating hydraulically operated means for expanding the lower end of the pile, certain hydraulic components being shown in schematic form.
Figure 7:
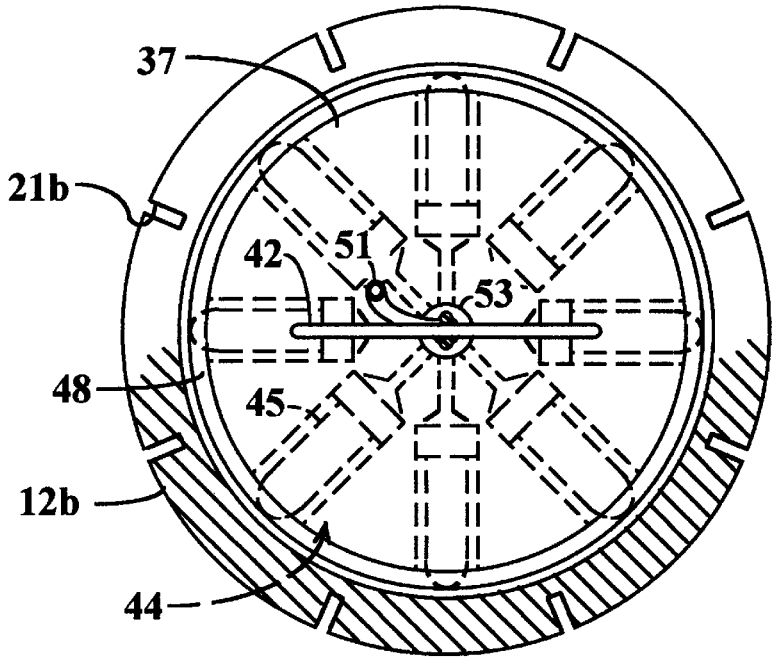
FIG. 7 is a cross section view taken along line 7—7 of FIG. 6.

The initial expansion of the base of the pipe can also be accomplished with any of a variety of non-explosive means. For example, with reference jointly to FIGS. 6 and 7, a hydraulic ram carrier housing 37 suspended by a chain 38 or the like may be lowered through the pipe 12*b* and into contact with the earth piercing shoe 16*b*. Housing 37 has a centered pilot projection 39 at its undersurface which seats in a conforming cavity 41 in the top of shoe 16*b* to locate the housing at a centered position within pipe 12*b*. In this example the chain 38 is coupled to an arched bail 42 which is welded to the top of the housing 37.

Housing 37 contains a plurality of hydraulic rams 44 which are directed towards the inner wall of pipe 12*b* and which extend along radii of the pipe in orientations at which extension of the rams exerts expansive pressure against the pipe at a series of equiangularly spaced apart locations on the inner wall. Each such ram 44 has a piston 46 formed at an inner end of a rod 45 which extends along the axis of a radial piston chamber 47 in housing 37 and into an opening in an annular retainer ring 48 which encircles the periphery of the housing 37 and which is secured to the housing 37 by screws 50. A compression spring 49 disposed in the piston chamber 47 in coaxial relationship with rod 45 bears against the piston 46 to urge the piston and rod towards a retracted position. The desired expansion of the base of the pipe 12*b* is effected by simultaneously directing high pressure hydraulic fluid into tapered inner ends 55 of each of the piston chambers 47 to force the pistons 46 towards the outer ends of the piston chambers. This causes the rods 45 to extend out of housing 37 and retainer ring 48 and to exert pressure against the inner surface of pipe 12*b*. This ruptures the lower end region of the pipe 12*b* at the weakened zones defined by the longitudinally extending grooves 21*b* and bends strips of the ruptured pipe outward into the configuration which has been previously described with reference to FIG. 4. Further driving of the pipe 12*b* into the ground then rapidly expands the base of the pipe in the manner which has been previously described.

Referring again to FIG. 6, pressurized hydraulic fluid for extending the rams 44 is supplied through a hose 51 which connects with a centered vertical passage 52 in housing 37 through a fitting 53 at the top of the housing and which is fed into the pipe 12*b* as the housing is being lowered. Passage 52 communicates with the tapered inner end 55 of each of the piston chambers 47. The hose receives high pressure fluid from a pump 54 that draws from a fluid reservoir 56. A two position valve 57 connected between the pump 54 and hose 51 is spring biased towards a normal position at which hose 51 is vented to reservoir 56. At that valve position springs 49 hold the hydraulic rams 44 at their retracted positions. Expansion of the base of pipe 16*b* is initiated by temporarily shifting valve 57 to the second valve position at which hose 51 is isolated from reservoir 56 and high pressure fluid from pump 54 is directed into the hose.

Restoring of the valve 57 to its first position vents the hose 51 thereby enabling springs 49 to retract the hydraulic rams 44. Housing 37 may then be withdrawn from the pipe 12*b* by means of chain 38 for reuse during installation of other bearing piles.

Figure 9:
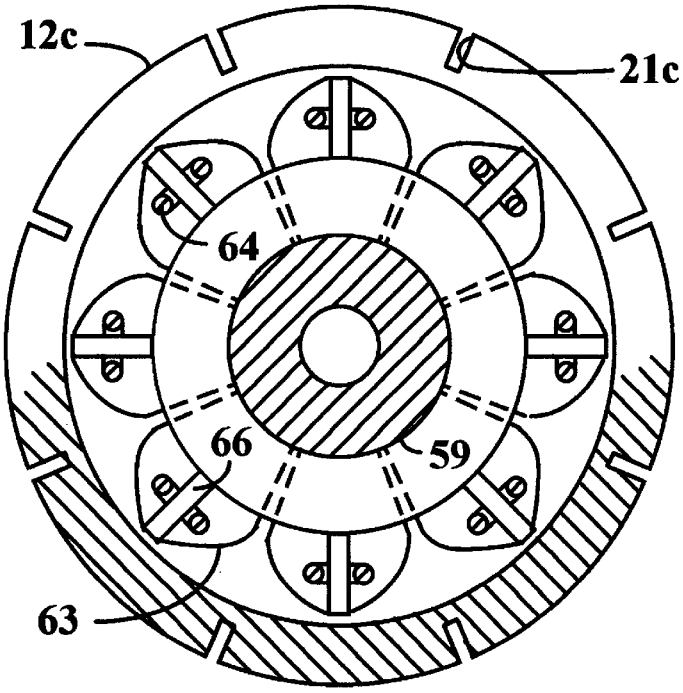
FIG. 9 is a cross section view taken along line 9—9 of FIG. 8.
Figure 8:
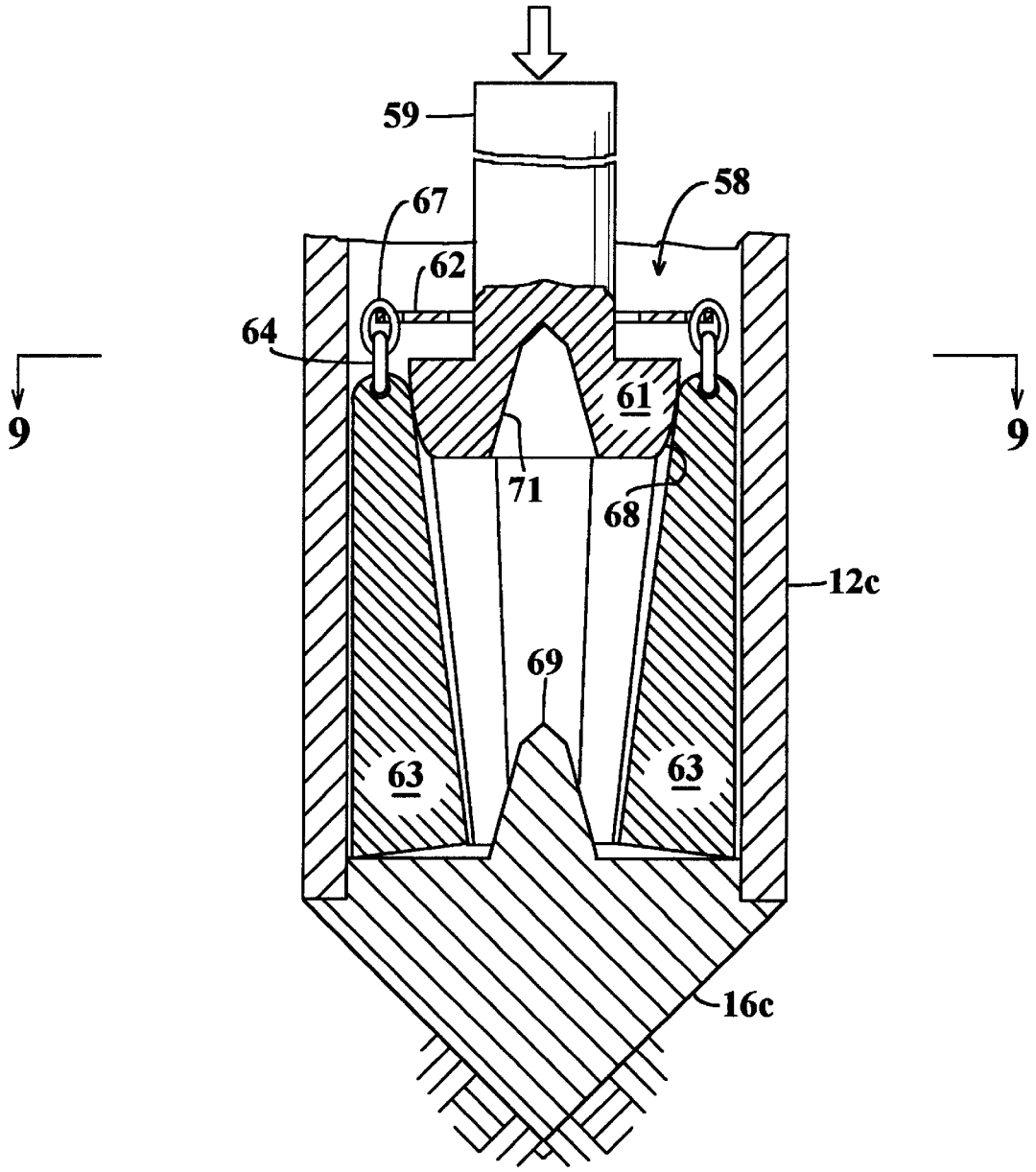
FIG. 8 is an elevation section view illustrating mechanical means for expanding the lower end of the pile by using a wedging action.

FIGS. 8 and 9 depict still another non-explosive apparatus 58 for expanding the base of the pipe 12*c* after the initial driving of the pipe into the ground. Apparatus 58 includes a long shaft 59, having a circular flange 61 at its bottom end, which is lowered into the pipe 12*c*. A ring 62 encircles the shaft 59 above flange 61 and a plurality of wedges 63 are suspended from the ring. Each such wedge 63 is coupled to the ring 62 by a lower closed loop link 64 which extends through an upward extending blade 66 at the top of the wedge and which is interlinked with an upper link 67 which engages ring 62. This mode of suspension of the fingers 63 enables pivoting motion of the wedges in the direction of the adjacent regions of the inner wall of pipe 12*c*.

Each wedge 63 has a thickness, taken along radii of the pipe 12*c*, which becomes progressively greater towards the bottom of the wedge. Flange 61 of shaft 59 has a curved peripheral surface 68 proportioned to contact the upper ends of the wedges 63 when the wedges are resting on the earth piercing shoe 16*c* and the flange is at the level of the upper ends of the wedges. Expansion of the base of the pipe 12*c* is then effected by hammering the shaft 59 further downward. This causes flange 61 to exert a wedging force which pivots wedges 63 outward against the inner wall of the pipe. This ruptures the lower region of the pipe 12*c* at the weakened zones established by the longitudinally extending grooves 21*c* and bends strips of the pipe outward to arrive at the pipe configuration previously described with reference to FIG. 4.

Referring again to FIGS. 8 and 9, the earth piercing shoe 16*c* is preferably provided with an upward extending conical pilot projection 69 at the center of the shoe which seats in a conforming cavity 71 at the center of the bottom end of shaft 59. This assures that the shaft 59 and wedges 63 are at a precisely centered location at the final stage of the expansion of the lower end of the pipe 12*c* and thereby provides for a symmetrical outward flaring of the pipe.

Following the expansion of the pipe 12*c*, shaft 59 is withdrawn from pipe 12*c*. The initial upward motion of flange 61 enables wedges 63 to pivot back towards the axis of the shaft 59 thereby enabling the withdrawal of the array of wedges along with the shaft.

After withdrawal of the shaft 59, the pile 11 is driven further into the ground to cause a rapid further expansion of the base of the pipe in the manner which has been previously described and during which the base of the pile 11*c* arrives at the greatly broadened configuration shown in FIG. 5.

A primary advantage of the invention is that a desired load bearing capacity may be realized with a greatly reduced penetration of the pile into the ground. The invention also increases the resistance of piles to uplifting or withdrawal in instances where there may be potential problems of that kind.

While the invention has been described with reference to certain specific embodiments for purposes of example, many modifications and variations are possible and it is not intended to limit the invention except as defined in the following claims.

I claim:

1. A structure supporting bearing pile which extends into the ground comprising:

a load bearing pipe having a main body portion which extends down into the ground and having a deformed lower end portion at which material of which the pipe is formed divides into strips that extend outward from the main body portion in different directions, outer ends of said strips being situated outwardly from the main body portion of the pipe, and an earth piercing shoe disposed at said lower end region of said pipe and having an undersurface which bears against underlying ground and having a peripheral region which is directly contacted by undersurfaces of the outwardly extending strips.

2. The structure supporting bearing pile of claim 1 wherein said peripheral region of said earth piercing shoe contacts said undersurfaces of said outwardly extending strips at locations thereon that are directly under said main body portion of said pipe and inward from said outer ends of said strips.

3. The structure supporting bearing pile of claim 1 wherein said strips extend downward and outward from said peripheral region of said earth piercing shoe.

4. The structure supporting bearing pile of claim 3 wherein said strips extend downward and outward from said peripheral region of said earth piercing shoe at substantially equal angular intervals around the peripheral region of said earth piercing shoe.

5. The structure supporting bearing pile of claim 1 wherein said strips are in direct contact with underlying ground.

* * * * *